US005487403A

United States Patent [19]

Mollo

[11] Patent Number: 5,487,403

[45] Date of Patent: Jan. 30, 1996

[54] VARIABLE DISCHARGE PUMP WITH LOW UNLOAD TO SECONDARY

[76] Inventor: James R. Mollo, 209 Julrich Ave., McMurray, Pa. 15317

[21] Appl. No.: 346,607

[22] Filed: Nov. 28, 1994

Related U.S. Application Data

[63] Continuation-in-part of Ser. No. 121,275, Sep. 13, 1993, Pat. No. 5,368,061, which is a continuation-in-part of Ser. No. 784,388, Oct. 29, 1991, Pat. No. 5,244,358, which is a continuation-in-part of Ser. No. 426,750, Oct. 24, 1989, abandoned, which is a continuation-in-part of Ser. No. 211,163, Jun. 22, 1988, abandoned, which is a continuation-in-part of Ser. No. 8,313, Jan. 29, 1987, abandoned.

[51] Int. Cl.[6] ..... F15B 13/06

[52] U.S. Cl. ..... 137/115; 91/516; 91/517; 137/596.13

[58] Field of Search ..... 137/115, 596.13; 91/516, 518, 517

[56] References Cited

U.S. PATENT DOCUMENTS

| | | | |
|---|---|---|---|
| 2,305,519 | 12/1942 | Dunmire . | |
| 3,324,881 | 6/1967 | Madison | 137/596.13 |
| 3,379,133 | 4/1968 | McCormick . | |
| 3,416,561 | 12/1968 | Joliet, III | 137/491 |
| 3,455,210 | 7/1969 | Allen | 91/446 |
| 3,488,953 | 1/1970 | Haussler . | |
| 3,718,159 | 2/1973 | Tennis | 137/596.12 |
| 3,722,543 | 3/1973 | Tennis | 137/596.12 |
| 3,811,471 | 5/1974 | Murase et al. | 137/596.13 |
| 3,828,813 | 8/1974 | Haussler | 137/596.13 |
| 3,861,145 | 1/1975 | Hall et al. | 60/427 |
| 3,868,821 | 3/1975 | Ratliff et al. | 60/421 |
| 3,882,896 | 5/1975 | Budzich | 137/596.1 |
| 3,934,742 | 1/1976 | Tennis . | |
| 4,040,438 | 8/1977 | Wilke | 137/106 |
| 4,043,419 | 8/1977 | Larson et al. | 180/132 |
| 4,122,865 | 10/1978 | Budzich | 137/596.13 |
| 4,159,724 | 7/1979 | Budzich | 137/596.13 |
| 4,520,902 | 6/1985 | Snow | 184/7.4 |
| 4,798,126 | 1/1989 | Budzich | 91/518 |
| 5,048,396 | 9/1991 | Torkler et al | 91/512 |
| 5,244,358 | 9/1993 | Mollo | 417/310 |
| 5,368,061 | 11/1994 | Mollo | 137/115 |

FOREIGN PATENT DOCUMENTS 2238355 8/1993 United Kingdom .

OTHER PUBLICATIONS

Manual MCV System, 3 pp. (no other available information) (undated).

Oilgear Engineering Data Bulletin No. 80006, pp. 1–3 (no other available information) (undated).

*Hydraulics & Pneumatics*, "Load–sensing Pumps: has their time come? Part 1: Load–and flow–sensing pumps are increasingly important to circuit designers", J. R. Mollo, May 1990, pp. 57, 58, 60, 72, & 74.

*Hydraulics & Pneumatics*, "Load–sensing Pumps: has their time come? Part 2 here are some tips to help designers apply load–sensing pumps", J. R. Mollo, Jul. 1990, pp. 91, 92 & 94.

Load Sense Variable Discharge High Pressure Gear Pump, G20–LS, John S. Barnes Corporation, pp. 1–6 (no other information available) (undated).

*Primary Examiner*—Gerald A. Michalsky

*Attorney, Agent, or Firm*—Webb Ziesenheim Bruening Logsdon Orkin & Hanson

[57] ABSTRACT

A load sensed variable output gear pump system including a pump within a housing, an inlet passage extending to a pump inlet and an outlet passage extending from a pump outlet. A secondary outlet passage is located in the housing and a bypass outlet passage is located in the housing and is connected to a reservoir. A load sensed passage is located in the housing and is connected to load pressure. First and second independent control devices are provided for controlling flow through the secondary outlet passage from the outlet passage.

10 Claims, 10 Drawing Sheets

VARIABLE DISCHARGE PUMP WITH LOW UNLOAD TO SECONDARY

CROSS-REFERENCES TO RELATED APPLICATIONS

The present application is a continuation-in-part of application Ser. No. 08/121,275, filed Sep. 13, 1993, now U.S. Pat. No. 5,368,061, which is a continuation-in-part of application Ser. No. 07/784,388, filed Oct. 29, 1991, now U.S. Pat. No. 5,244,358, which is a continuation-in-part of application Ser. No. 07/426,750, filed Oct. 24, 1989, now abandoned, which is a continuation-in-part of application Ser. No. 07/211,163, filed Jun. 22, 1988, now abandoned, which is a continuation-in-part of application Ser. No. 07/008,313, filed Jan. 29, 1987, now abandoned.

BACKGROUND OF THE INVENTION

1. Field of the Invention

This invention generally relates to apparatus for internally controlling the bypass flow in a fixed displacement pump in response to external load and flow requirements in a load responsive system.

More particularly, the invention relates to the internal control of pump discharge pressure to a secondary load circuit at a value of 2.5 psi greater than the pump discharge pressure in the standby load responsive condition via a single signal from the load responsive system or systems.

2. Background of the Invention

Load responsive directional control valves with bypass style compensators such as are described in Haussler U.S. Pat. Nos. 3,488,953 and 3,882,896 and in Budzich U.S. Pat. No. 4,159,724 have greatly increased system efficiency by lowering the horsepower requirements with reference to the use of a load responsive bypass style compensator. The arrangement disclosed in my U.S. Pat. No. 5,244,358, the disclosures of which are incorporated herein by reference, which includes low unload, further reduces horsepower loss over the control valves disclosed in the-aforementioned Haussler and Budzich patents by approximately 50%. The horsepower consumption is also reduced by the arrangement disclosed in my U.S. Pat. No. 5,368,061, the disclosures of which are also incorporated herein by reference. The,above-mentioned prior art patents to Haussler and Budzich deal with load sensed directional valves with bypass control to a reservoir. Only my above-identified United States patents deal with pump controlled low unload to a reservoir with variable bypass to the reservoir. It would be beneficial to use bypass fluid for auxiliary functions by replacing the bypass to the reservoir in prior designs with a bypass to secondary load sensitive circuits.

This general type of control in the art is known as a priority type flow device of the load sense type. Remote load sensitive priority devices are disclosed in U.S. Pat. No. 3,455,210 to Allen; U.S. Pat. No. 4,043,419 to Larson et al.; and United Kingdom Patent No. 2,238,355.

The function of the remote load sensitive priority devices described in the Allen and Larson et al. patents and the United Kingdom patent is a valve or a pump containing a hydrostat. A hydrostat is a device well-known in the art to provide equal pressure sensitive areas offset by a load spring of a fixed value and is spring loaded to the open position in reference to the valve inlet and the priority valve outlet port which is connected to load. Fluid flow cannot be diverted to the secondary through the hydrostat until the priority pressure drop exceeds the set spring force on the hydrostat thereby diverting the excess flow to the secondary circuit. The net result, depending on the manufacture, is a minimum 125 psi unloaded condition. The steering control disclosed in the Larson et al. patent may not be used with some known low unload pumps which do not produce sufficient pressure to load the secondary in a plurality of load sensitive valves.

SUMMARY OF THE INVENTION

An object of the present invention is to bypass flow at a low pressure drop to a secondary circuit while maintaining the integrity of the priority flow concept. One embodiment of the present invention uses two controls and allows the passage to tank the capability of independent action through a second tank passage creating the possibility of low unload and bypass to a secondary system.

It is also an object of the invention to utilize separate controls so that the bypass to secondary is variable in spring load as opposed to a fixed spring load, therefore compensating for the distance and piping pressure losses caused by the remote location of the priority control orifices.

It is a further object of the invention, through the use of separate controls, to cause the low unload to secondary not to exceed 2.5 psi in pressure drop. This, when compared to a 125 psi drop currently used, results in a 95% horsepower reduction in the standby mode of operation, and in a maximum horsepower savings of 10% in the secondary run only condition.

A complete understanding of the invention will be obtained from the following description when taken in connection with the accompanying drawing figures wherein like reference characters identify like parts throughout.

DESCRIPTION OF THE PREFERRED EMBODIMENTS

Figure 2:
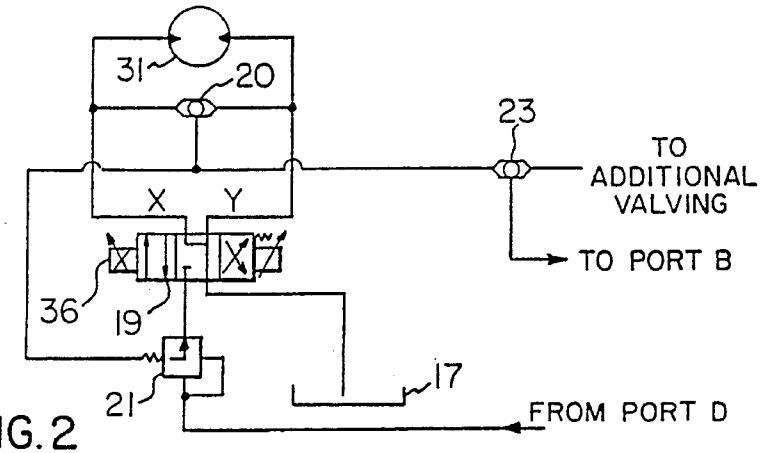
FIG. 2 is a schematic representation of a load responsive system wherein the load is a motor.

FIG. 2 of the drawings shows a load responsive system such as described in U.S. Pat. No. 5,368,061. A hydraulic motor 31 is the output device connected to a load, and the speed and torque delivered to the load is a function of fluid flow (motor speed) and fluid pressure (motor output torque). The combination of a load sensing shuttle valve 20, a proportional direction control valve 19 and a non-bypass style inlet hydrostat 21 embody a typical load responsive valve system such as disclosed in the aforementioned Haussler patents. The in-line inlet hydrostat 21 is well-known in the art as a device containing a spool and a poppet or a plunger having identically sized end faces which cause the device to be hydrostatically balanced when subject to pressure. Hydrostat 21 uses the pressure drop across the metering spool contained in valve 19 to cause a constant fluid flow regardless of upstream pressure fluctuations when a plurality of control valves are simultaneously in use. This condition is known as pressure compensation. Additional valves may be added in parallel in reference to the valve inlet pressure port and shuttled together in reference to load via a shuttle valve 23. The load responsive system transmits only the highest load pressure registered to the hydraulic variable discharge pump. The pressure signal due to the center configuration of valve 19 is either ON to load or OFF to zero pressure, i.e., coupled to reservoir 17. The bypass style hydrostat is known in the art as a parallel hydrostat as opposed to the in-line or series type hydrostat. The bypass style hydrostat cannot be used with a variable output pump or a discharge type pump.

Figure 1:
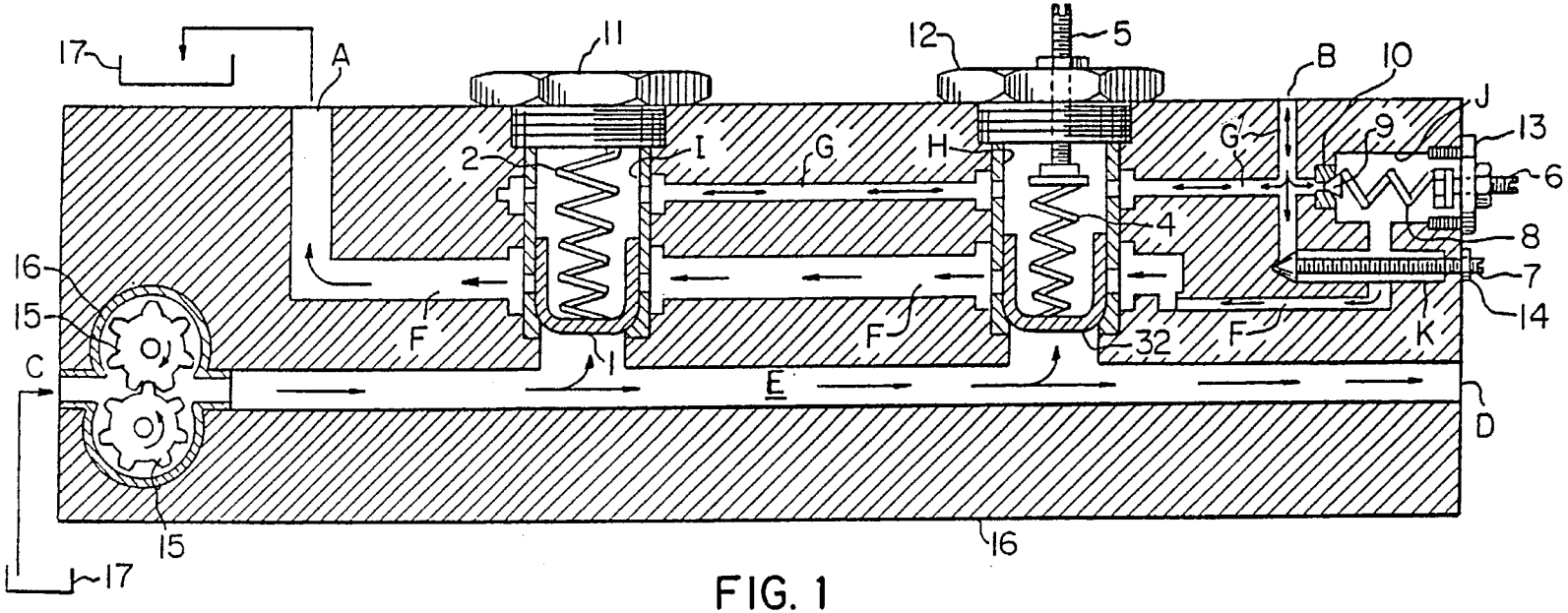
FIG. 1 is a longitudinal section of a load sensed variable output gear pump.

Referring to FIG. 1 of the drawings, which is also described in my parent application, a variable output or discharge gear pump of the load sense type is shown. The pump includes a low unload control 11, a high pressure relief or system compensator control 13, a response tuning adjustable orifice 14 and a bypass control or adjustable parallel hydrostat 12.

Control 11 has a 2:1 effective and pressure sensitive area ratio in reference to chamber I and chamber E regarding the movement of poppet 1. The adjustable hydrostat 12 has an identical pressure sensitive area in reference to chamber H and chamber E causing poppet 32 to react in reference to the load responsive signal delivered through port B to passage G. Control 11 and hydrostat 12 are in parallel through their connection to passage E. This plurality of controls causes an additive pressure drop that can be diminished by combining control 11 and control 12 into a single controller in also speeding up the overall pump response time.

The operation of the pump shown in FIG. 1 of the drawings is set forth hereinafter. In the neutral condition, the control valve or valves 19 will be in a P pressure blocked with lines X and Y coupled to reservoir or tank 17, shown as a spring center condition. This neutral condition of pump 16 is shown in FIG. 1 and the neutral condition of valve 19 is schematically represented in FIG. 2 of the drawings. As gears 15 rotate, hydraulic fluid is directly pulled from reservoir 17, through inlet port C and is discharged from gears 15 to passage E and out-port D and through the inlet in-line hydrostat 21 to the pressure blocked port on valve 19, thus deadheading the pressure line. Spring 2, in control 11, will begin to be depressed by the pressure exerted against the area of poppet 1 through passage E. At a low pressure of 30 psi or less in passage E, poppet 1 will move enough to connect passage E to passage F through control 11, allowing fluid to pass out of port A to reservoir 17. Fluid at this time cannot pass from passage E to F through control 12 as the tension in spring 4 is adjustable in a range of 60 to 300 psi thereby holding poppet 32 in the closed position. At this time all flow produced by gears 15 is passing through unload control 11 to reservoir 17 at a low pressure drop. As no fluid flow is present past the pressure blocked port in control valve 19, pump load sense port B, feels only reservoir pressure in passage G, and in turn chamber H of control 12, and chamber I of control 11. Poppet 1 in unload control 11 has a 2:1 pressure effective area ratio with respect to chamber I and passage E. The unbalanced areas allow spring 2 to be made of a relatively light gauge wire.

This means that the effective area on which pressure can be applied to poppet 1 through passage E is 50% less than the effective area on which pressure can be applied to poppet 1 through chamber I. If the pressure in chamber I is reservoir pressure or essentially zero, the amount of pressure in passage E required to open passage E to passage F would be at least equal to the amount of pressure exerted on the poppet 1 in unload control 11 by spring 2.

Referring to FIG. 2 of the drawings, valve 19 is a proportional control valve which is pressure compensated by valve 21. Valve 20 is a shuttle valve providing an alternative signal in relation to load activation as an output signal from the load or actuator to a controller or, in this case, pump 16. As power is applied to a solenoid 36, valve 19 is shifted to the right, allowing flow passage P to flow over compensator valve 21 through valve 19 to a motor 31. The load is transmitted through shuttle valve 20 to an additional shuttle-valve 23. Shuttle valve 23 transmits the load pressure to port B. Port B transmits the pressure through passage G to chamber H in control 12, chamber I in control 11, to control screw 7 for adjustable orifice 14, and to control poppet 9 of control 13. As soon as any significant positive pressure is exerted on chamber I, control 11 closes, stopping flow from passage E to passage F across unload control 11. This means that when unload control 11 has the same or greater pressure exerted on chamber I in reference to the pressure exerted in passage E, unload control 11 will move to the closed position. This occurs because of the aforementioned area ratio difference that, disregarding the light gauge of spring 2, requires twice the amount of force in regard to the pressure in passage E as opposed to the pressure in chamber I to move poppet 1. As unload control 11 closes, control 12 begins to open passage E to passage F modulating the flow and bypassing only enough fluid to maintain a predetermined pressure drop. As unload control 11 closes, the pressure in passage E and chamber I continues to increase, causing control 12 to begin to open due to the bias set by spring 4. This pressure drop is variable and is regulated by screw 5 which controls the tension on spring 4 in control 12.

Only unload control 11 maintains a 2:1 area ratio in reference to passage E and chamber I, as aforementioned. Control 12 is spring-biased and has an effective area ratio of 1:1 in reference to passage E and chamber H, causing control 12 to be the only truly biased control. As passage G senses load pressure and this pressure is applied to chamber H of control 12, the total pressure on poppet 32 in chamber H is the tension of spring 4 plus load pressure.

If the pump output flow, due to downstream restrictions in the piping or control valve assembly 19, is not sufficient, the spring tension can be increased by adjusting screw 5 of control 12. Pressure will increase with load until the setting on control 13 is reached. At a predetermined and adjustable pressure, poppet 9 will lift off seat 10 allowing flow from passage G to chamber J. The pressure setting in control 13 is set by screw 6 to change the tension on spring 8. This offsets the balance pressure in chamber H allowing increased flow to passage F from passage E keeping the pressure from exceeding the preset pressure in control 13. If the controlled response is too fast, control 14 can be adjusted by turning screw 7, causing a control response lag by controlled leakage from passage G to passage K which is interconnected with passage F and to reservoir 17. When valve 19 returns to the neutral condition, pump 16 returns to the first mentioned condition.

Figure 3:
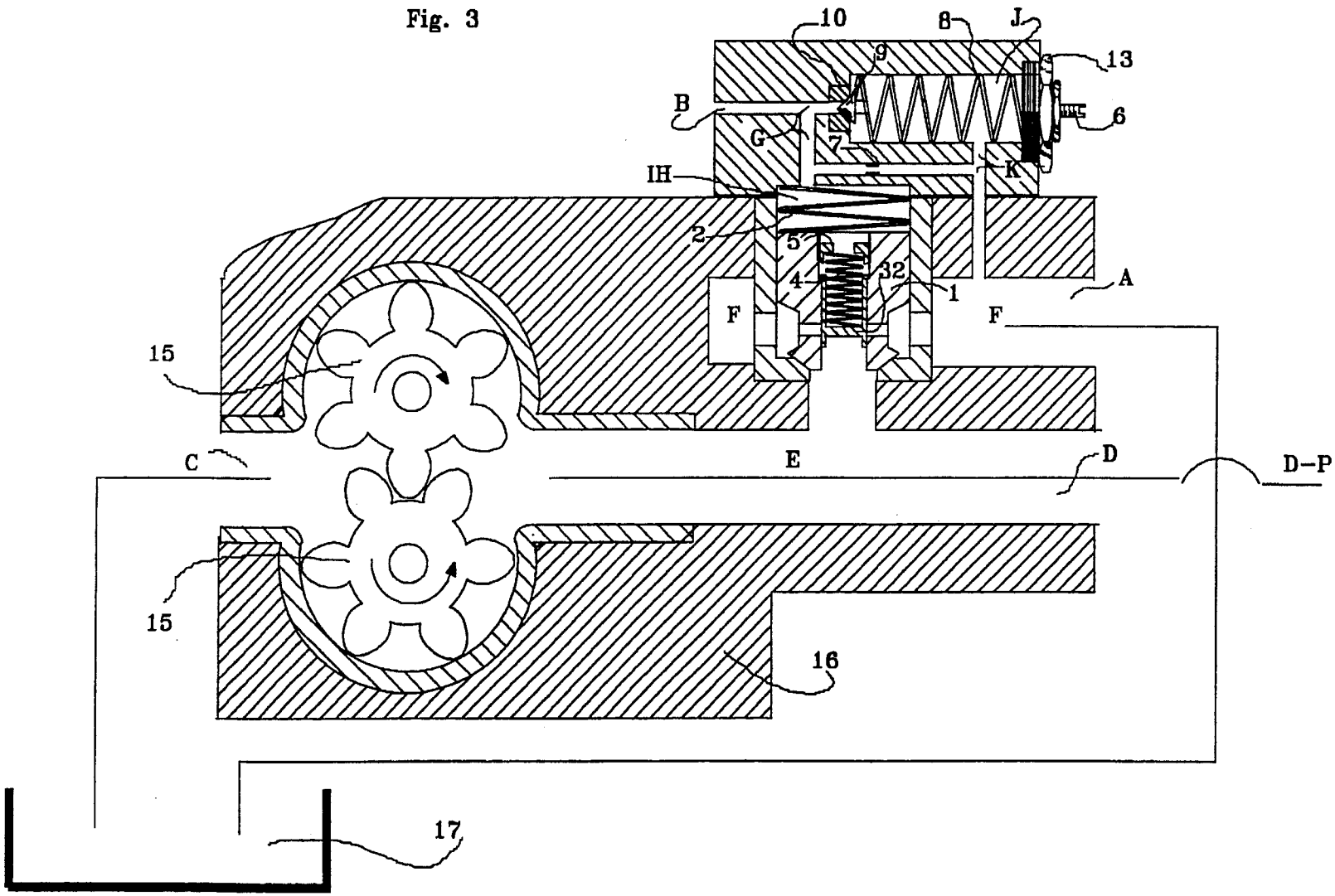
FIG. 3 is a longitudinal section of a gear pump with a combined low unload bypass control with a hydrostat having a spool design.
Figure 5:
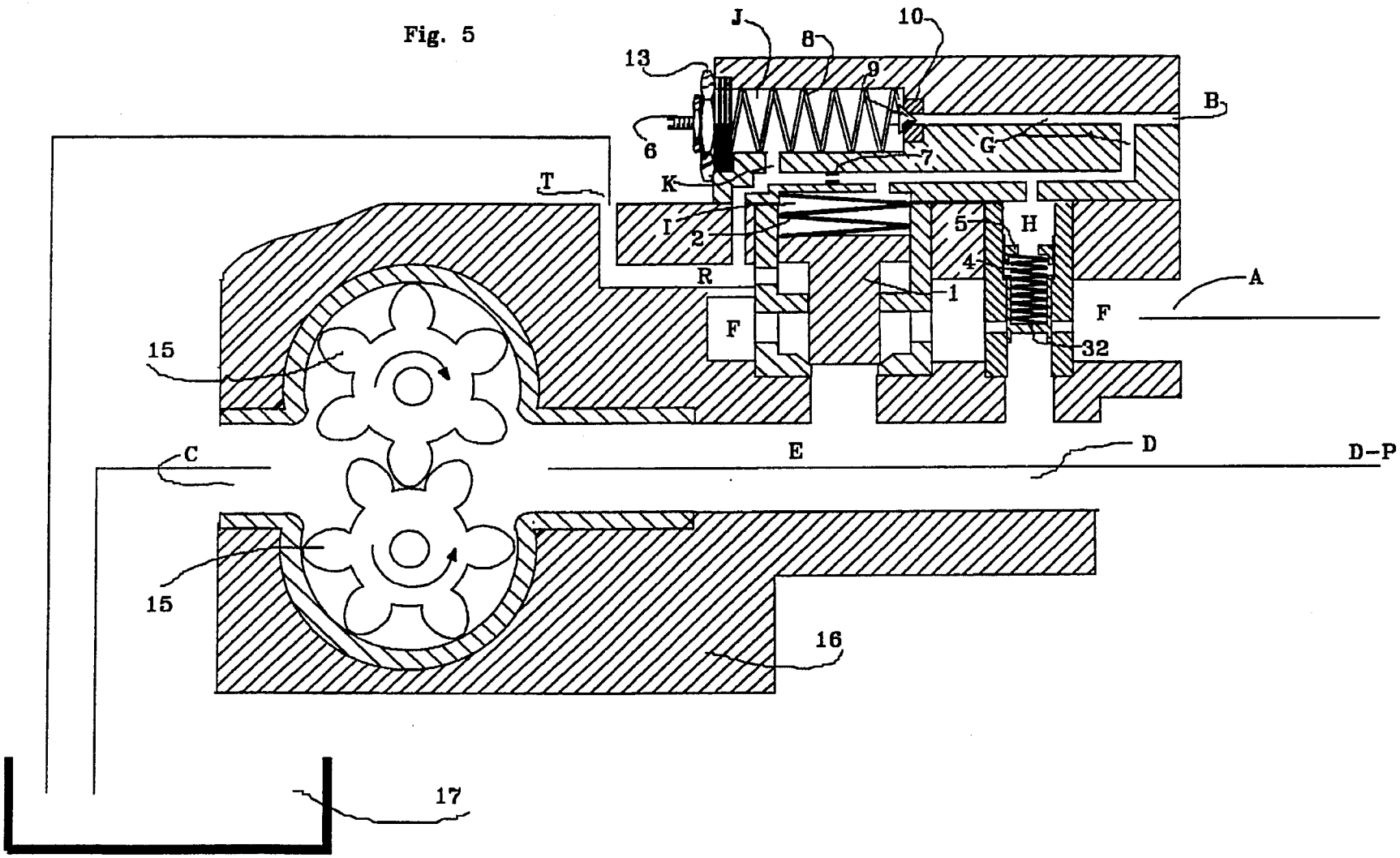
FIG. 5 is a longitudinal section of a load sensed variable output gear pump with a low unload plunger connected to secondary having a spool design bypass hydrostat which incorporates an additional passage to reservoir allowing low unload to a secondary load sensitive circuit.

FIG. 3 of the drawings shows a further improvement of the invention, also described in my parent application, which combines control 11 and control 12 of FIG. 1 into chamber IH, spring 2, adjustment 5, spool 32, spring 4 and poppet 1. This design accomplishes the previously mentioned actions of controls 11 and 12 in a single unit control. The combination control shown in FIG. 3 has been rotated counterclockwise for the purpose of explanation only and is shown in FIG. 5 of the drawings in the actual position relative to the pump discharge volute.

The operation of the pump shown in FIG. 3 of the drawings is set forth hereinafter. In the neutral condition, the control valve or valves 19 will be P pressure blocked with X and Y coupled to reservoir 17, this being the center condition. This neutral condition of the pump 16 is shown in FIG. 3.

As the pump gears 15 rotate, hydraulic fluid is pulled from reservoir 17 through inlet port C and is discharged from gears 15 to passage E and out-port D and through inlet in-line hydrostat 21 to the pressure blocked port on valve 19, thus deadheading the pressure line. Spring 2, in the combined control, will begin to be depressed by the pressure exerted against the area of poppet 1, in communication with passage E. At a low pressure of 30 psi or less in passage E, poppet 1 will move against the force of spring 2 to connect passage E to passage F, the combined control thereby allowing fluid to pass out of port A to reservoir 17. Fluid at this time will not pass from passage E to passage F through combined control spool 32 as the tension in spring 4 is adjustable by adjustment 5 in a range of 60 to 300 psi, thereby holding spool 32 in the closed position. At this time all flow produced by the rotation of gears 15 in pump 16 is passing through the combined control to reservoir 17 at a low pressure drop. As no fluid flow is present past the pressure blocked port in control valve 19, the pump load sense port B receives only the reservoir pressure in passage G and in turn chamber IH of the combined control. Poppet 1 in the combined control has a 2:1 pressure effective area ratio in regard to chamber IH and to passage E. The unbalanced areas allow spring 2 to be of a light gauge and to be removed if a near atmosphere unload condition is required. If the pressure in chamber IH is reservoir pressure or zero, the amount of pressure in passage E required to open passage E to passage F would be equal when the pressure exerted on the area of poppet 1 by the pressure in passage E which exceeds the amount of pressure exerted on the poppet 1 by spring 2.

Referring to FIG. 3 of the drawings, as power is applied to the solenoid 36, valve H is shifted to the right which allows flow passage P to flow over compensator valve 21 through valve 19 to motor 31. The amount of load pressure is transmitted through shuttle valve 20 to shuttle valve 23 which transmits the load pressure to pump 16 and entering port B. Port B transmits the pressure through passage G to chamber IH in the combined control to removable metering orifice 7 and to control 13 for poppet 9. As soon as any positive pressure is exerted on chamber IH, combined control poppet 1 closes, stopping flow from passage E to passage F across the combined control. This means that when the combined control has the same or greater pressure exerted on chamber IH in reference to the pressure exerted in passage E, combined control poppet 1 moves to the closed position. This occurs because of the aforementioned area ratio difference that requires two times the force in regard to the pressure in passage E as opposed to the pressure in chamber IH. As combined control poppet 1 closes, combined control spool 32 begins to open passage E to passage F modulating the flow and bypassing only enough fluid to maintain a predetermined pressure drop. As combined control poppet 1 closes, the pressure in passage E and chamber IH continues to increase causing combined control spool 32 to begin to open due to the bias set on the control by the force of spring 4. This pressure drop is variable and is regulated by screw 5 which controls the tension on spring 4. Combined control spool 32 is spring-biased and has an effective area ratio of 1:1 in reference to passage E and chamber IH which causes combined control spool 32 to be the only truly biased control. As passage G senses load pressure and this pressure is supplied to chamber IH of the combined control, the total pressure in passage E is spring tension plus load pressure.

The pressure will increase with load until the setting on control 13 is reached. At a predetermined and adjustable pressure, poppet 9 lifts from seat 10 to allow flow from passage G to chamber J. The pressure setting of control 13 is adjusted by screw 6 to change the tension on spring 8. This offsets the balance pressure in chamber IH allowing more flow to passage F from passage E preventing the pressure from exceeding the preset valve in control 13. If the controlled response is too fast, orifice 7 may be altered in size to cause a control response lag by means of a controlled leakage from passage G to passage K which is connected to passage F and to reservoir 17.

When valve 19 returns to the neutral condition, pump 16 returns to the first mentioned condition.

Figure 4:
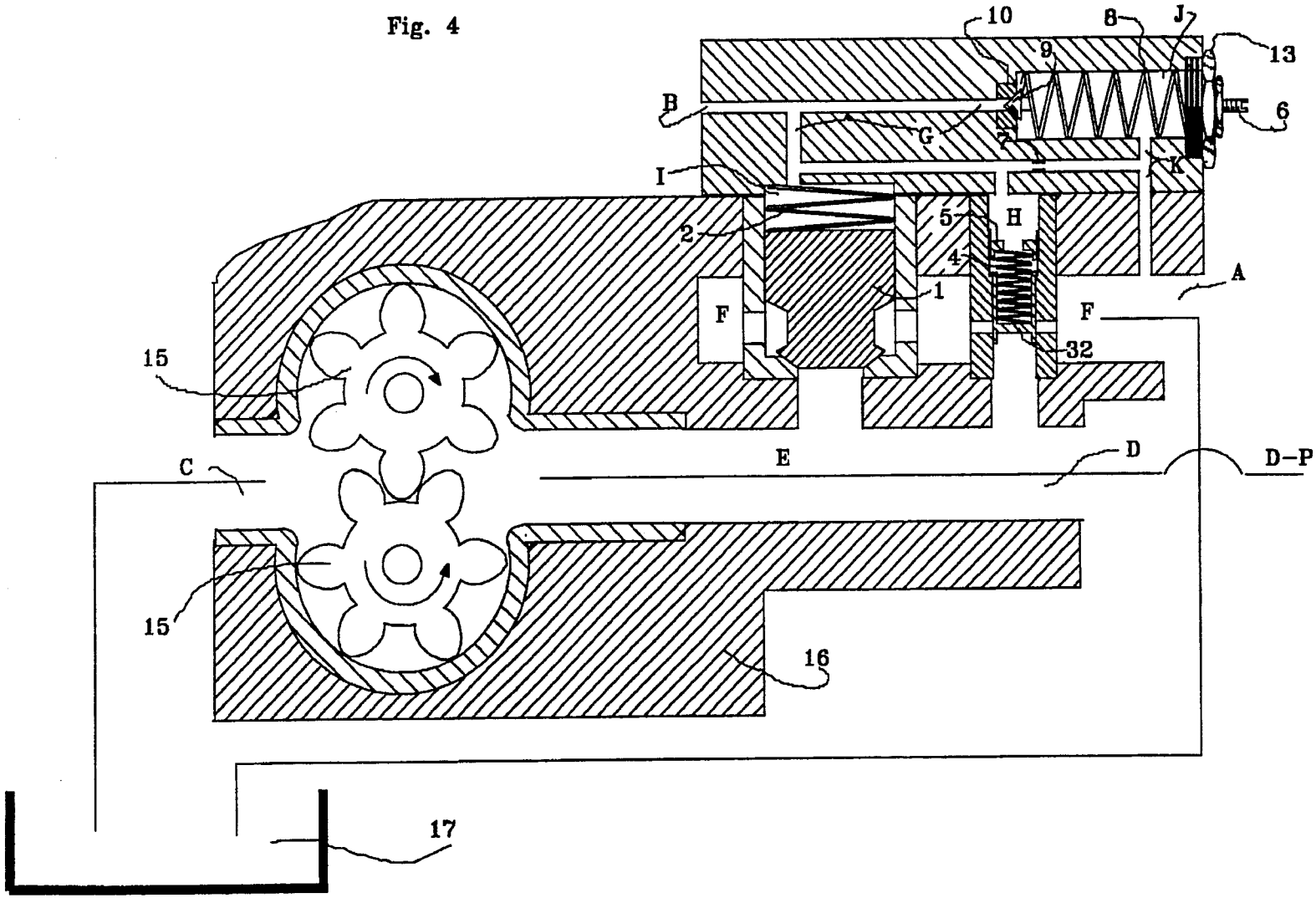
FIG. 4 is a longitudinal section of a load sensed variable output gear pump with the hydrostat bypass having a spool design.

The pump shown in FIG. 4 of the drawings operates identically to the pump shown in FIG. 1. The only physical difference is that poppet 32 has a spool design in FIG. 4 to permit a more finite metering characteristic of the fluid. Poppet 11 has a 2:1 or greater effective pressure sensitive area difference. The function of the pump shown in FIG. 4 is identical to the aforementioned function of the pump shown in FIG. 1 in conjunction with the described and aforementioned load of FIG. 2.

The pump shown in FIG. 5 of the drawings is an embodiment of the present invention which redefines the poppet 1 shown in FIG. 4 as a plunger and incorporates an additional tank or reservoir port passage R connected with a passage T permitting the operation of a second pressurized function at a decreased pressure drop.

Figure 6A:
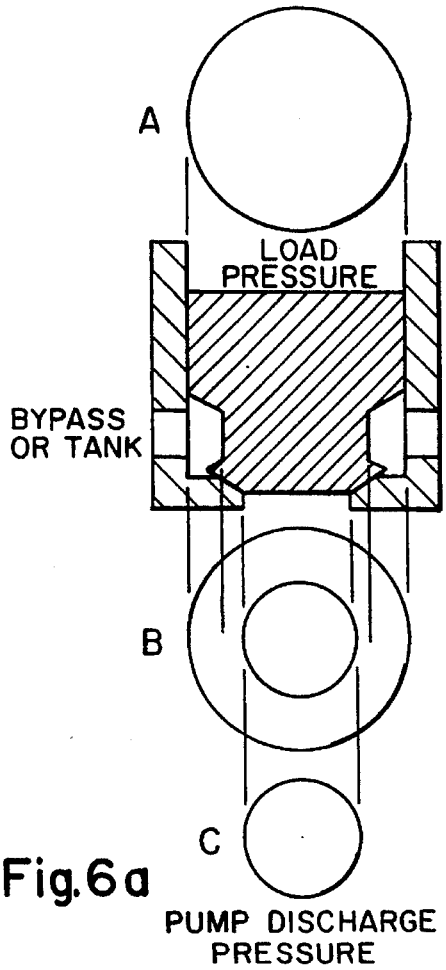
FIGS. 6*a–c* are, respectively, sections of the low unload poppet, the combined low unload bypass control, and the low unload bypass to secondary plunger with pressure effective areas.
Figure 6B:
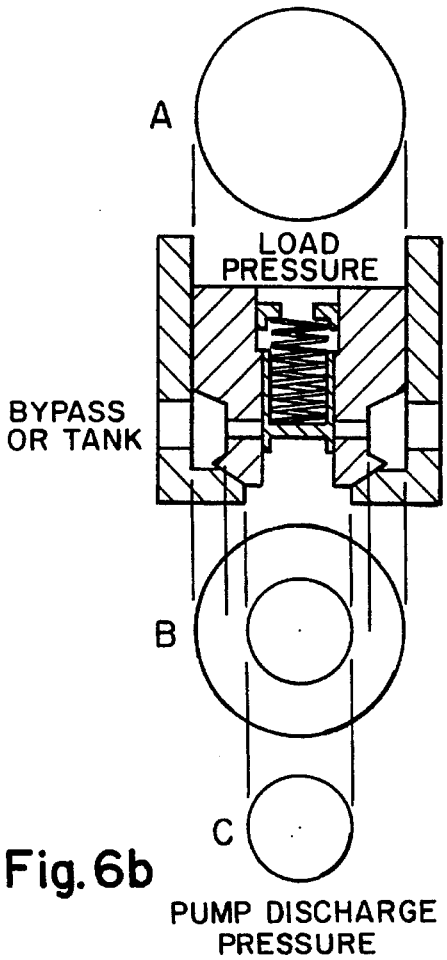
Figure 6C:
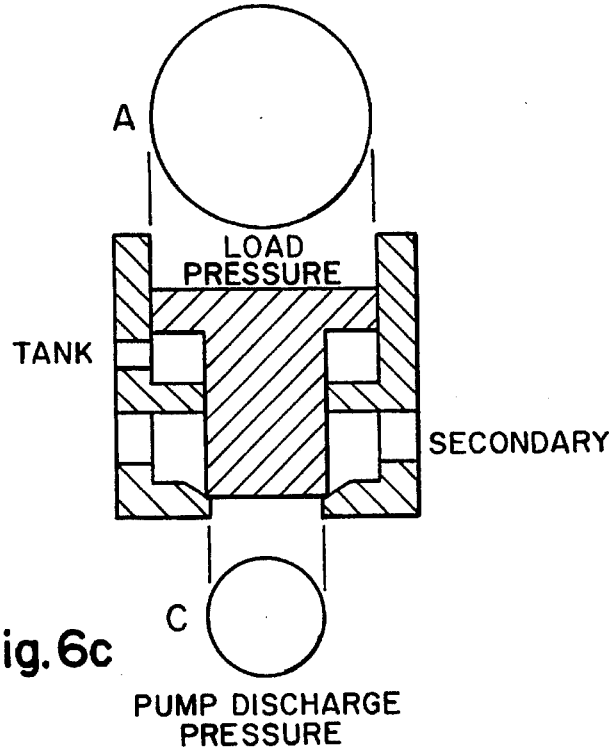

The low unload poppet 1 shown in FIGS. 1 and 4 of the drawings, the combined control poppet 1 and spool 32 illustrated in FIG. 3 of the drawings and the plunger control 1 illustrated in FIG. 5 of the drawings are shown in FIGS. 6*a–c*., respectively, and function as previously stated. Positive pressure greater than tank in passage F will negate the 2:1 area ratio causing the controls illustrated in 6*a* and 6*b* to work as a hydrostat on a 1:1 area ratio. FIG. 6*c* shows the control with a plunger design illustrated in FIG. 5 with additional tank passage R. Even with additional tank or reservoir passage R, control 6*c* maintains the 2:1 area ratio when passage F is subjected to pressure.

Figure 7:
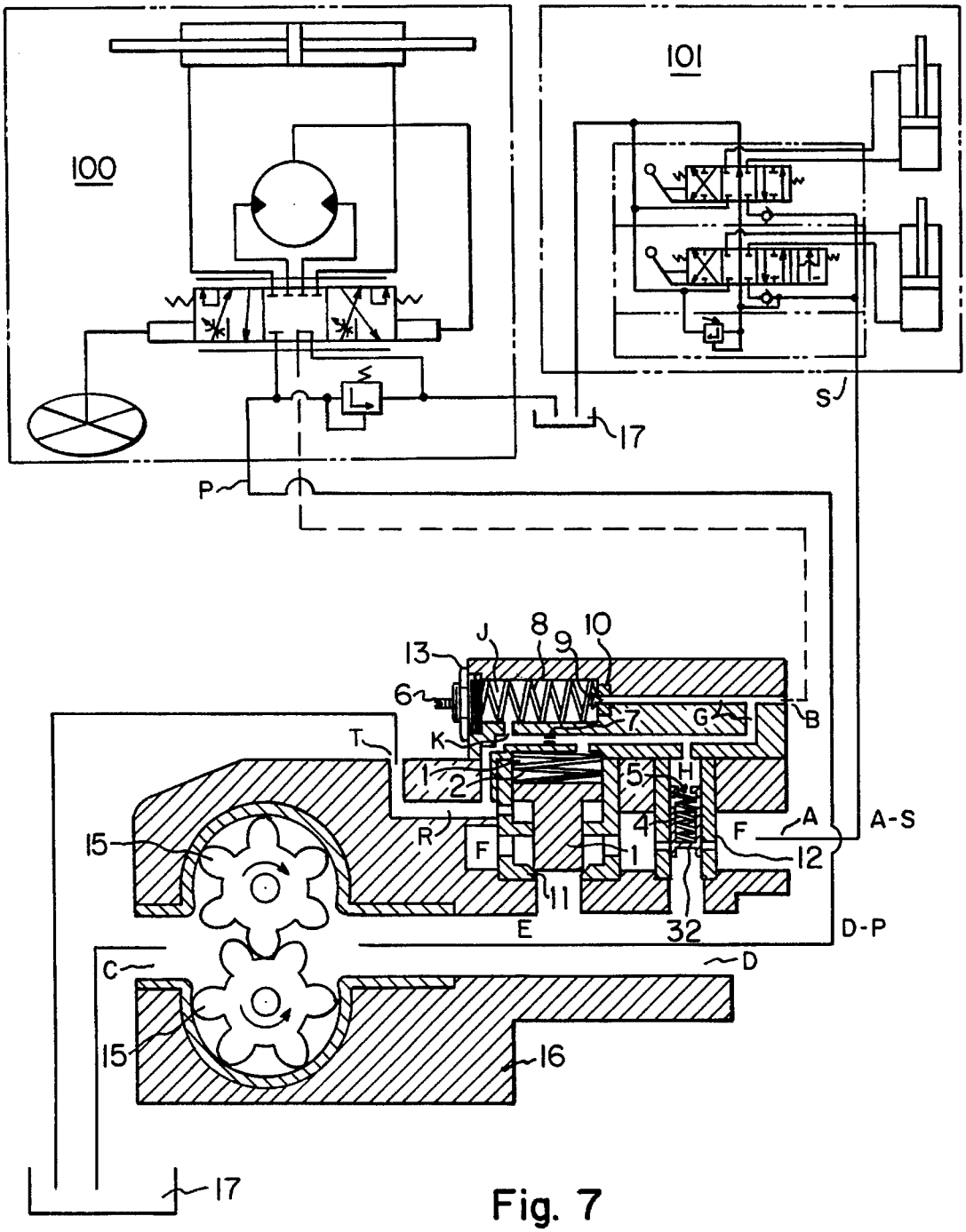
FIG. 7 is a longitudinal section of a load sensed variable output gear pump with a low unload plunger connected to the secondary shown in FIG. 5 including schematic representations of a priority load and a secondary load.

The pump shown in FIG. 7 of the drawings is a duplicate of the pump in FIG. 5 and shows an embodiment of the improvement of this application with reference to two loads. FIG. 7 shows a schematic representation of a load responsive load system in which a load 100 and a load 101 represent conventional load systems. For example, load 100 is a schematic representation of a load sense steering circuit such as shown in the aforementioned Larson et al. patent. Load 101 is a schematic representation of a multiple directional control valve using cylinders as a load function also known in the art as an open center directional control valve of the non-load sensed type. All loads and the pump 16 shown in FIG. 7 are in the neutral position.

The pump shown in FIG. 7 operates in accordance with the following description. In the neutral condition, the steering valve in load 100 is in the pressure blocked position with the load sense line to reservoir 17. The directional control valves schematically illustrated in load 101 are in the pressure to reservoir 17 position allowing all fluid flow entering port S in load 101 to proceed through load 101 to reservoir 17 in what is known as the spring centered position. The neutral condition of pump 16 is shown in FIG. 5 and is illustrated in the neutral condition in reference to aforementioned loads 100 and 101 in FIG. 7. As gears 15 in pump 16 are rotated, hydraulic fluid is pulled directly from reservoir 17 through inlet port C. The fluid is discharged from gears 15 of pump 16 into passage E and out-port D and through inlet P to the pressure blocked steering valve in load 100, thus deadheading the pressure line. Spring 2 in control 11 will begin to be depressed by the pressure exerted against the area of plunger 1 from passage E. At a low pressure of 2.5 psi or less in passage E, plunger 1 will move enough to connect passage E to passage F through control 11 to allow fluid to pass out port A to inlet port S of load 101 which is in the aforementioned neutral condition and is connected with reservoir 17. Fluid at this time cannot pass from passage E to passage F through control 12 as the tension in spring 4 is adjustable in a range of 60 to 300 psi thereby holding spool 32 in the closed position. At this time all flow produced by the rotation of gears 15 of pump 16 passes through control 11 and load 101 to reservoir 17 at a low pressure drop. As no fluid flow is present past the pressure blocked port in the steering directional load 100, the pump load sense port B, senses only reservoir pressure in passage G and in chamber H of control 12 and chamber I of control 11. Plunger 1 in control 11 has a 2:1 pressure effective area ratio in regard to chamber I and passage E which is described in detail hereinabove. Any back pressure on passage F created by line loss or by losses in load valve 101 is nullified by passage R which is coupled to reservoir 17. The unbalanced areas allow spring 2 to be of a light gauge.

Referring to FIG. 7 of the drawings, when steering load 100 is activated it connects the steering load directly to passage B in pump 16 and ceases to be connected with reservoir 17. Port B transmits the pressure through passage G to chamber I and chamber H to orifice 7 and to poppet 9 of control 13. As soon as any positive pressure is exerted on chamber I, plunger 1 closes to stop the flow from passage E to passage F. This means that when control 11 has the same or greater pressure exerted on chamber I in reference to the pressure exerted in passage E, the combined control plunger 1 moves to the closed position. This occurs because of the aforementioned area ratio difference. As plunger 1 of control 11 closes, the pressure in passage E and chamber I and chamber H continues to increase causing the control spool 32 of control 12 to begin to open due to the bias set on control 12. This pressure drop is variable and is regulated by screw which controls the tension on spring 4. The spool 32 of control 12 is spring-biased and has an effective area ratio of 1:1 in reference to passage E and chamber H, causing control spool 32 to be the only truly biased control. As passage G senses load pressure and this pressure is applied to chamber H of control 12, the total pressure in passage E is spring tension plus load pressure.

If the pump output flow, due to downstream restrictions in the piping or the steering load valve 100, is not sufficient, the spring tension can be increased by adjusting screw 5 in control 12. Pressure will increase with load until the setting on control 13 is reached.

At a predetermined and adjustable pressure, poppet 9 lifts off seat 10 to allow flow from passage G to chamber K. The high pressure in control 13 is set by screw 6 which changes the tension on spring 8. This offsets the balance pressure in chamber I and chamber H allowing more flow to passage F from passage E keeping the pressure from exceeding the preset valve in control 13. If the controlled response is too fast, the size of orifice 7 may be altered to cause a control response lag due to a controlled leakage from passage G to passage K which is interconnected to passage R and reservoir 17.

When the steering load 100 returns to the neutral condition, pump 16 returns to the first-mentioned condition.

When valve 101 is activated it is non-load sensed, only valve 100 is load sensitive, and connects pump discharge port A to valve 101 inlet passage S to load only. In the neutral running condition, pump 16 is delivering all flow to secondary passage F to the inlet port of valve 101 and to reservoir 17 at a low pressure drop of 2.5 psi. This means that when load 101 is in the operational position connecting load to inlet port S, and connected with pump passage E and passage F, the only pressure drop felt is the load created by spring 2 in control 11, as chamber I in control 11 is at zero psi. When load 101 is activated the pump delivers all flow through passage E at a pressure drop of 2.5 psi to the load ignoring the pressure drop of control 12. This low unload to the secondary function reduces the bias value normally felt on control 12 by 95%. It is important to note that the inlet pressure port P to load 100 in this condition is subjected to full secondary pressure. The load in reference to load 100 activation, will shut down plunger 1 in control 11 maintaining the integrity of the priority flow pump port D. It should also be noted that in the simultaneous functioning of load 100 and load 101 in FIG. 7, inlet compensator valve 21 in FIG. 2 may be used to adjust for flow variations if the priority circuit to load 101, when the secondary load denotes a higher pressure value than the priority circuit.

Figure 8:
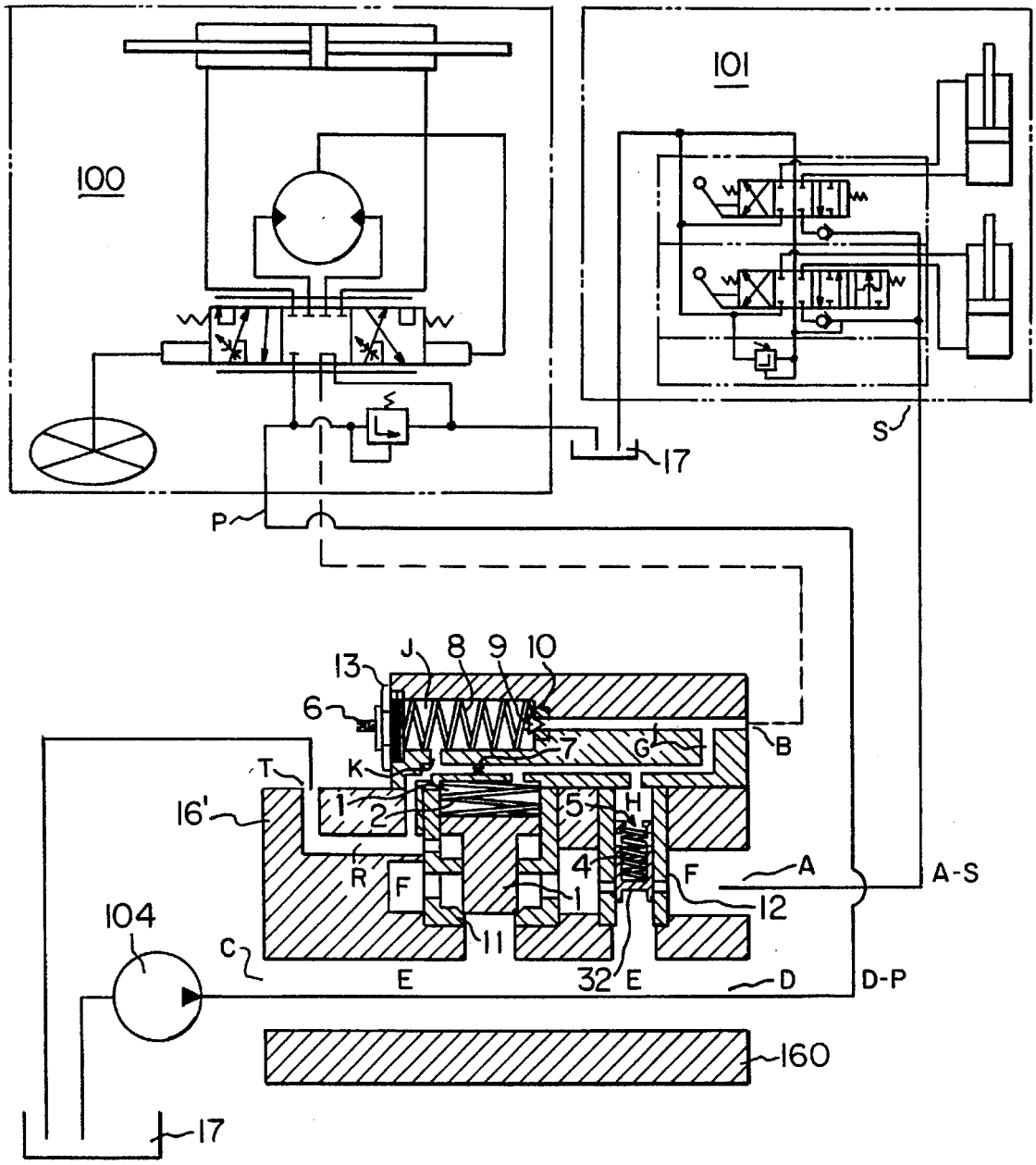
FIG. 8 is a longitudinal section of a load sensed variable output control with a low unload plunger connected to secondary having a spool design bypass hydrostat including schematic representations of a fixed pump, a priority load and a secondary load.

Referring to FIG. 8 of the drawings, wherein steering load 100, load 101 and pump 104 are illustrated schematically, valve 16' contains control 13, control 11 and control 12. The controls 11, 13 and 12 in valve 16' function identically with their counterparts in pump 16 in FIG. 7 in respect of the identical loads 100 and 101.

Replacing the priority flow control devices with the low unload to secondary valve as discussed herein with respect to FIG. 8 results in a net horsepower savings of 95%. The net savings in horsepower cannot be as great as pump 16 in FIG. 7 because the distance from pump 104 to pump control valve 16' increases the pressure loss dependent on the line size and the distance between pump 104 and valve 16'. Another reason to construct the controls 11, 12 and 13 in a single valve is discussed hereinafter with reference to FIG. 9 of the drawings.

Figure 9:
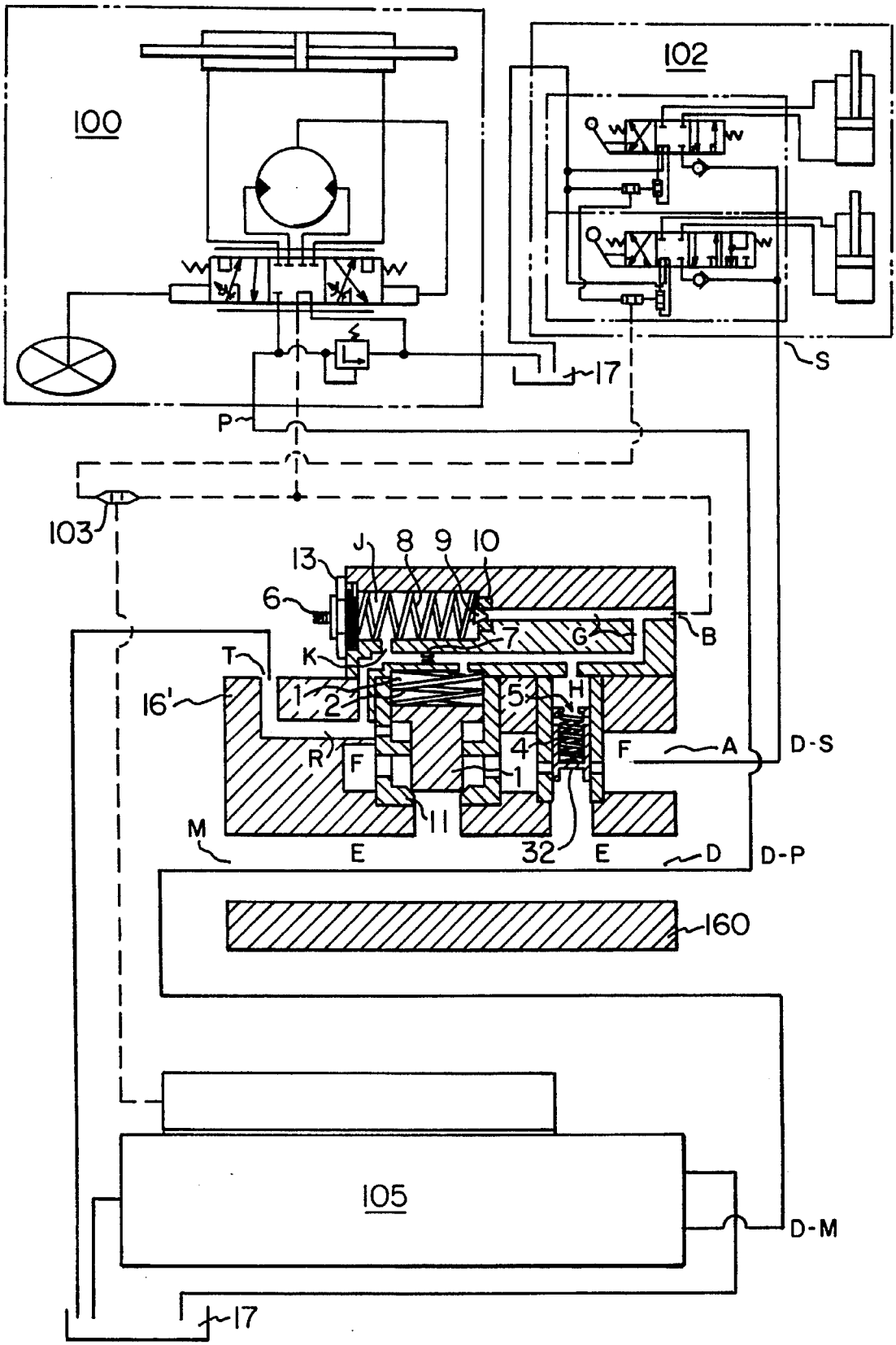
FIG. 9 is a longitudinal section of a load sensed variable output control including schematic representations of a low unload bypass control with a hydrostat having the spool design shown in FIG. 3 of the drawings in combination with a section of the load sensed variable output control with a low unload plunger connected to secondary having a spool design bypass hydrostat according to FIG. 8 and schematic representations of a priority load and multiple secondary loads.

Referring to FIG. 9 of the drawings, steering load 100, load 102, shuttle valve 103 and pump 105 are illustrated schematically. Pump 105 is identical to pump 16 shown in FIG. 3. In the neutral condition, the steering directional valve in load 100 is in the pressure blocked position with the load sense line to reservoir 17 in the spring center condition. In the neutral condition, the load directional valve in load 102 is in the pressure blocked position with the load sense line to reservoir 17 and is connected with load sense port B of valve 16' in the spring center condition. This means that shuttle valve 103 is subject to zero pressure. The prior art patents teach that the pressure drop across the priority circuit must be recognized before fluid is delivered to the secondary load. The use of valve 16' through the low unload to secondary in reference to control 11 in the arrangement shown in FIG. 9 of the drawings lowers the loss in the neutral load valve condition due to the pressure drop across the priority circuit. If control 11 was not present in the arrangement shown in FIG. 9, in reference to the load sense variable discharge pump 105, the pump low unload pressure of 30 psi or less would be insufficient to activate pump 105 as in the prior art patents.

Figure 10:
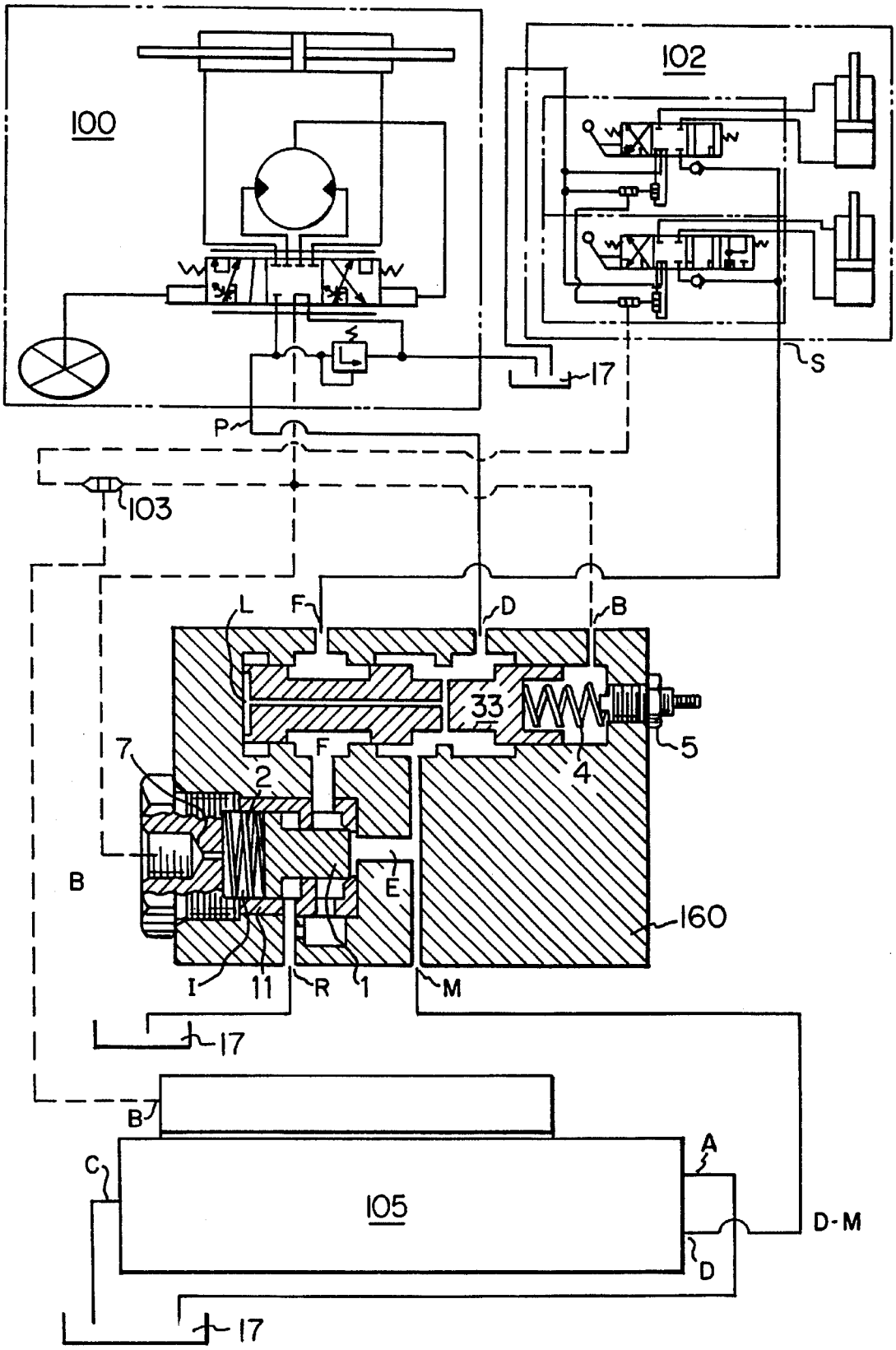
FIG. 10 is a schematic representation of a combined low unload bypass control with a hydrostat having a spool design shown in FIG. 3 in combination with a section through a load sensed variable output control having low unload plunger connected to secondary including an adjustable spool design load sensed priority hydrostat and schematic representations of a priority load and multiple secondary loads.

In FIG. 10 of the drawings, wherein steering load 100, load 101, shuttle valve 103 and pump 105 are illustrated schematically. Pump 105 is identical to pump 16 in FIG. 3. In the neutral condition, the steering directional valve in load 100 is in the pressure blocked position with the load sense line to reservoir 17 in the spring center condition. In the neutral condition, the load directional valve in load 101 is in the pressure blocked position with the load sense line to reservoir 17 and is connected to load sense port B of valve 106 in the spring center condition. This means that shuttle valve 103 feels zero pressure. The spool or piston 33 in valve 106 is now positioned in series with steering load valve 100. Hydrostat spool 33 is loaded by spring 4 and is adjustable by adjustment screw 5. Control 11 functions as the low unload to secondary at 2.5 psi.

Figure 11:
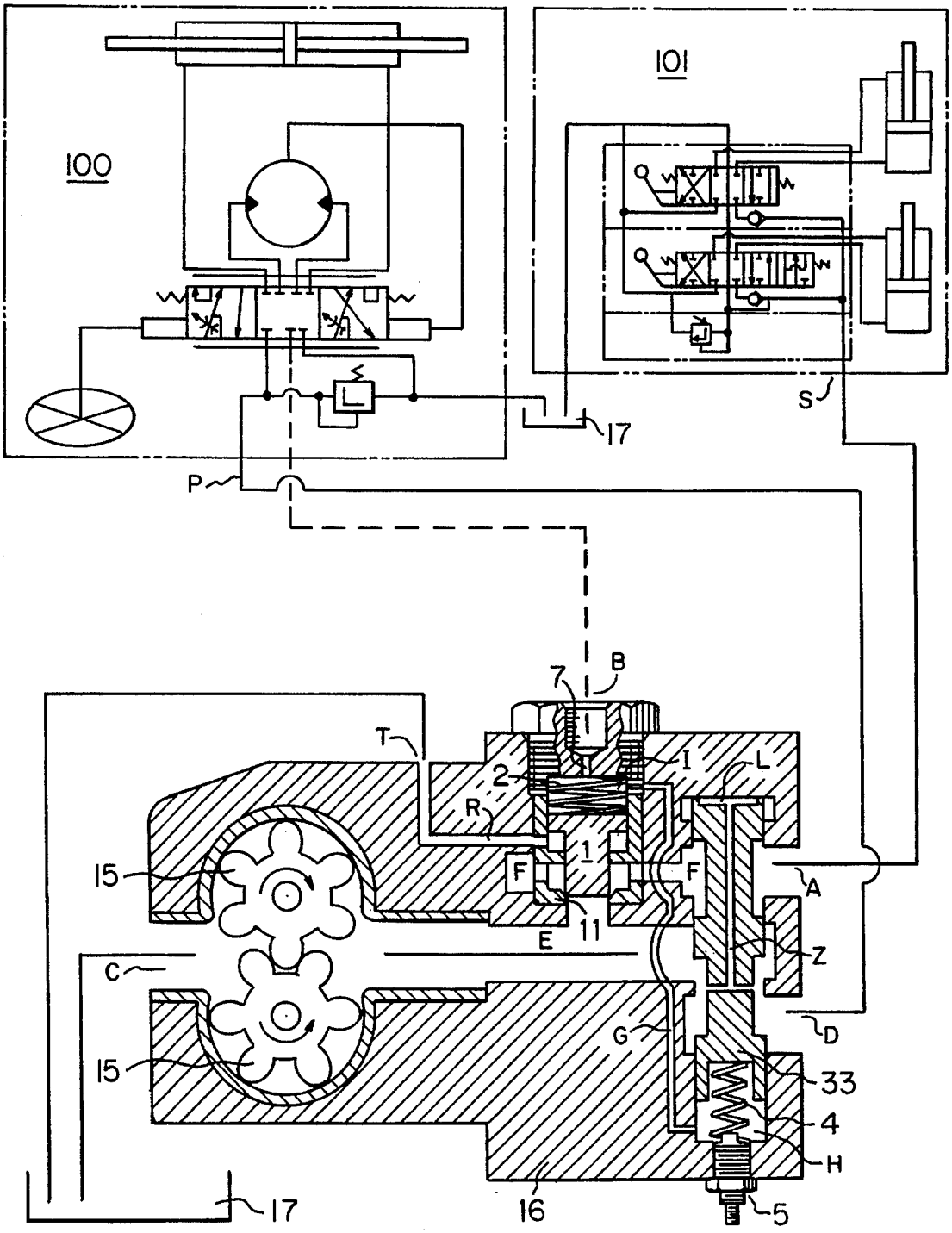
FIG. 11 is a longitudinal section of a load sensed variable output gear pump with a low unload plunger connected to secondary using a spool design bypass hydrostat and a schematic representation of a priority load and multiple secondary loads.

FIG. 11 of the drawings shows a schematic representation of a load responsive system including load 100 and load 101. All loads and pump 16 illustrated in FIG. 11 are in the neutral condition.

The operation of the arrangement shown in FIG. 11 is as follows: In the neutral condition, the steering directional valve in load 100 is in the pressure blocked position with the load sense line to reservoir 17 in the spring center condition. The directional control valves schematically illustrated in load 101 are in the pressure to reservoir position allowing all fluid entering port S to proceed through load 101 to reservoir 17 in the spring centered condition. As gears 15 in pump 16 rotate, hydraulic fluid is directly pulled from the reservoir 17 through port C. The fluid is discharged from gears 15 to passage E. Spool 33 is in series with load 100 and passage E and is held in a normal open position by spring 4. Outlet port D is connected through passage Z to the opposing equal area chamber L of spool or piston 33 in chamber H thereby forming a hydrostat or equal pressure sensitive device. The design of spool or piston 33 is similar to piston 43 in the Allen patent. Flow from passage E passes spool 33 as aforementioned and passes out port D and through inlet P to the pressure blocked steering valve in load 100, thus dead-heading the pressure line. Spring 2 in control 11 will begin to be depressed by the pressure exerted against the area of plunger 1 in flow connection with passage E. At a low pressure of 2.5 psi or less in passage E plunger 1 will move enough to connect passage E to passage F through control 11 to allow fluid to pass out of port A to inlet port S of load 101 which was in the neutral condition and connected to reservoir 17. Fluid at this time cannot pass from passage E to passage F through spool 33 as the tension in spring 4 is adjustable in a range of 60 to 300 psi thereby holding spool 33 in the closed position in reference to passage E and passage F across control 11. At this time all flow produced by the rotation of gears 15 in pump 16 is passing through control 11 through load 101 to reservoir 17 at a low pressure drop. As no fluid flow is present past the pressure blocked port in the steering directional load 100 pump load sense port B feels only reservoir pressure in passage G, chamber H and chamber I. Plunger 1 has a 2:1 pressure effective area ratio in regard to chamber I and passage E. Any back pressure on passage F created by line loss or losses in load 101 is nullified by passage R which is connected to reservoir 17. The unbalanced areas allow spring 2 to be of a light gauge.

When load 100 is activated it connects the steering load directly to passage B in pump 16 and ceases to be connected to reservoir 17. Port B transmits the pressure through orifice 7 to chamber I and through passage G to chamber H. As soon as any positive pressure is exerted on chamber I plunger 1 closes to stop flow from passage E to passage F through control 11. This means that when plunger 1 has the same or greater pressure exerted on chamber I in reference to the pressure exerted in passage E, plunger 1 shifts to the closed position. As plunger 1 closes the pressure in passage E, chamber I and chamber H continues to increase causing spool 33 to begin to open due to the bias on spool 33 by spring 4, metering the required fluid flow from passage E to port D and bypassing the excess flow from passage E to passage F over spool 33. This pressure drop is variable and is regulated by screw 5 which controls the tension on spring 4. Spool 33 is adjustably spring-biased and has an effective area ratio of 1:1 with reference to chamber L and chamber H, thereby causing spool 33 to be the only truly biased control. As passage G senses load pressure and this pressure is applied to chamber H the total pressure in passage E will be spring tension plus load pressure.

If the pump output flow, due to downstream restrictions in the piping or the steering load 100 is not sufficient, the spring tension can be increased by adjusting screw 5 on spool 33. If the controlled response is too fast, metering orifice 7 may be altered in size to cause a lag in the response of plunger 1 and spool 33.

When the steering load valve 100 returns to the neutral condition pump 16 will return to the first-mentioned condition.

When steering load valve 100 and load valve 101 return to the neutral condition pump 16 will return to the first-mentioned condition.

While different embodiments of the invention have been described in detail herein, it will be appreciated by those skilled in the art that various modifications and alternatives to the embodiments could be developed in light of the overall teachings of the disclosure. Accordingly, it should be understood that the particular arrangements are illustrative only and are not limiting as to the scope of the invention which is to be given the full breadth of the appended claims and any and all equivalents thereof.

I claim:

1. A load sensed variable output gear pump system comprising:

a housing;

a fluid delivery pump within said housing having an inlet and an outlet;

a main inlet passage located in said housing and extending to said inlet of said pump;

a main outlet passage located in said housing and extending from said outlet of said pump, whereby fluid in said main outlet passage is pressurized by said fluid delivery pump;

a secondary outlet passage located in said housing;

a bypass outlet passage located in said housing and adapted to be connected to a reservoir;

a load sensed passage located in said housing and connected to load pressure;

a first control means for controlling flow through said secondary outlet passage from said main outlet passage, said first control means including:

i) a first chamber located in said housing having a first chamber inlet opening connected to said main outlet passage, a first chamber outlet opening connected to said secondary outlet passage, a first chamber load opening connected to said load sensed passage and a first chamber bypass opening connected to said bypass outlet passage, and ii) a plunger movably positioned within said first chamber and movable between a first position closing said first chamber inlet opening and a second position spaced from said first chamber inlet opening for allowing fluid to flow through said first chamber inlet opening between said main outlet passage and said secondary outlet passage, said plunger having an effective surface area ratio of 2:1 between an area of said plunger acted upon by pressure from said load sensed passage and an area of said plunger acted upon by pressure from said main outlet passage, wherein said plunger is in said second position when no pressure is applied to said load sensed passage, whereby said main outlet passage is connected to said secondary outlet passage; and a second control means for controlling flow through said secondary outlet passage from said main outlet passage, said second control means including:

i) a second chamber located in said housing having a second chamber inlet opening connected to said main outlet passage, a second chamber outlet opening connected to said secondary outlet passage and a second chamber load opening, ii) a spool within said second chamber movable between a first position closing said second chamber inlet opening and a second position spaced from said second chamber inlet opening allowing fluid to flow through said second chamber inlet opening between said main outlet passage and said secondary outlet passage, said spool having an effective surface area of 1:1 between an area of said spool acted upon by pressure from said load sensed passage and an area of said spool acted upon by pressure from said main outlet passage, and iii) a spring biasing said spool towards said first position, wherein said spool is in said first position when no pressure is applied to said fluid load sensed passage.

2. A gear pump system as set forth in claim 1 further including a restricting orifice connecting said load sensed passage to said bypass outlet passage.

3. A gear pump system as set forth in claim 2 further including:

overload control means for controlling flow through said restricting orifice from said fluid load sensed passage, said overload control means including:

i) a third chamber located in said housing having a third chamber inlet opening connected to said load sensed passage and a third chamber outlet opening connected to said bypass outlet passage, ii) a poppet positioned within said third chamber and movable between a first position closing said third chamber inlet opening and a second position spaced from said third chamber inlet opening allowing fluid to flow through said third chamber inlet opening between said load sensed passage and said bypass outlet passage through said third chamber, iii) a spring biasing said poppet toward said first position, and iv) an adjustment means for adjusting the tension of said spring.

4. A load sensing valve assembly comprising:

a valve housing;

a pressurizing source;

a main inlet-outlet passage extending through said housing and connected to said pressurizing fluid source;

a secondary outlet passage located in said housing;

a bypass outlet passage located in said housing and adapted to be connected to a reservoir;

a load sensed passage located in said housing and connected to load pressure;

a first control means for controlling flow through said secondary outlet passage from said main inlet-outlet passage, said first control means including:

i) a first chamber located in said housing having a first chamber inlet opening connected to said fluid main inlet-outlet passage, a first chamber outlet opening connected to said secondary outlet passage, a first chamber load opening connected to said load sense passage and a first chamber bypass opening connected to said bypass outlet passage, and ii) a plunger movably positioned within said first chamber and movable between a first position closing said first chamber inlet opening and a second position spaced from said first chamber inlet opening for allowing fluid to flow through said first chamber inlet opening between said fluid main inlet-outlet passage and said outlet passage, said plunger having an effective surface area ratio of 2:1 between an area of said plunger acted upon by pressure from said load sensed passage and an area of said plunger acted upon by pressure from said main inlet-outlet passage, wherein said plunger is in said second position when no pressure is applied to said load sensed passage, whereby said main inlet-outlet passage is connected to said secondary outlet passage; and a second control means for controlling flow through said secondary outlet passage from said main inlet-outlet passage, said second control means including:

i) a second chamber located in said housing having a second chamber inlet opening connected to said main inlet-outlet passage, a second chamber outlet opening coupled to said secondary outlet passage and a second chamber load opening, ii) a spool within said second chamber movable between a first position closing said second chamber inlet opening and a second position spaced from said second chamber inlet opening allowing fluid to flow through said second chamber inlet opening between said main inlet-outlet passage and said secondary outlet passage, said spool having an effective surface area of 1:1 between an area of said spool acted upon by pressure from said load sensed passage and an area of said spool acted upon by pressure from said main inlet-outlet passage, and iii) a spring biasing said spool towards said first position, wherein said spool is in said first position when no pressure is applied to said load sensed passage.

5. A valve assembly as set forth in claim 4 further including:

a restricting orifice connecting said load sense passage to said bypass outlet passage; and overload control means for controlling flow through said restricting orifice from said load sense passage, said overload control means including:

i) a third chamber located in said housing having a third chamber inlet opening coupled to said load sensed passage and a third chamber outlet opening connected to said bypass outlet passage, ii) a poppet positioned within said third chamber and movable between a first position closing said third chamber inlet opening and a second position spaced from said third chamber inlet opening allowing fluid to flow through said third chamber inlet opening between said load sensed passage and said bypass outlet passage through said third chamber, iii) a spring biasing said poppet toward said first position; and iv) means for adjusting the tension of said spring.

6. A valve assembly as set forth in claim 4 wherein said pressurizing source is a load sensed variable output gear pump connected to said main inlet-outlet passage, a pressurizing source bypass outlet passage adapted to be connected to a reservoir, and a load sensing pressurizing source control for controlling flow from said main inlet-outlet passage to said pressurizing source bypass outlet passage.

7. A load sensed variable output gear pump system comprising:

a housing;

a fluid delivery pump having an inlet side and an outlet side located in said housing;

a main inlet passage located in said housing and extending to said inlet side of said pump;

a main outlet passage located in said housing and extending from said outlet side of said pump, whereby fluid in said main outlet passage is pressurized by said fluid delivery pump;

a secondary outlet passage located in said housing;

a bypass outlet passage located in said housing and adapted to be connected to a reservoir;

a load sensed passage located in said housing and connected to load pressure;

a first control means for controlling flow through said secondary outlet passage from said main outlet passage, said first control means including:

i) a first chamber located in said housing having a first chamber inlet opening connected to said main outlet passage, a first chamber outlet opening connected to said secondary outlet passage, a first chamber load opening connected to said fluid load sensed passage, a first chamber bypass opening connected to said fluid bypass outlet passage and a first chamber load outlet, and ii) a plunger positioned within said first chamber and movable between a first position closing said first chamber inlet opening and a second position spaced from said first chamber inlet opening allowing fluid to flow through said first chamber inlet opening between said main outlet passage, said plunger having an effective surface area ratio of 2:1 between an area of said plunger acted upon by pressure from said load sensed passage and an area of said plunger acted upon by pressure from said main outlet passage; and a second control means for controlling flow through said secondary outlet passage from said outlet passage, said second control means including:

i) a second control opening formed in said housing allowing fluid communication between said main outlet passage and said secondary outlet passage, ii) a piston located in said housing movable between a first position closing said second control opening and a second position allowing fluid to flow through said second control opening, iii) a spring for biasing said piston to said first position, iv) means for adjusting tension of said spring, v) a piston chamber defined by said housing and said piston and a piston chamber passage located in said piston providing fluid communication between said main outlet passage and said piston chamber, vi) a load chamber defined by said housing and said piston and a load connecting passage located in said housing connected to said first chamber load outlet and to said load chamber;

wherein said piston has an effective surface area of 1:1 between an area of said piston acted upon by pressure in said piston chamber and an area of said piston acted upon by pressure in said load chamber, and wherein said piston is in said first position when no pressure is applied to said load chamber.

8. A pump system as set forth in claim 7 including a restricting orifice connecting said load sense passage to said first chamber.

9. A valve assembly comprising:

a housing;

a pressurizing source;

a main inlet-outlet passage extending through said housing and connected to said pressurizing source;

a secondary outlet passage located in said housing;

a bypass outlet passage located in said housing and adapted to be connected to a reservoir;

first and second load passages located in said housing and each of said first and second load passages connected to load pressure;

a first control means for controlling flow through said secondary outlet passage from said main outlet passage, said first control means including:

i) a first chamber located in said housing and having a first chamber inlet opening connected to said main outlet passage, a first chamber outlet opening connected to said secondary outlet passage, a first chamber load opening connected to said first load passage, and a first chamber bypass opening connected to said bypass outlet passage, and ii) a plunger positioned within said first chamber and movable between a first position closing said first chamber inlet opening and a second position spaced from said first chamber inlet opening allowing fluid to flow through said first chamber inlet opening between said main outlet passage and said secondary passage, said plunger having an effective surface area ratio of 2:1 between an area of said plunger acted upon by pressure from said load sensed passage and an area of said plunger acted upon by pressure from said main outlet passage, and a second control means for controlling flow through said secondary outlet passage from said outlet passage, said second control means including:

i) a second control opening formed in said housing connecting said main outlet passage and said secondary outlet passage;

ii) a piston located in said housing movable between a first position closing said second control opening and a second position allowing fluid to flow through said second control opening;

iii) a spring for biasing said piston to said first position;

iv) means for adjusting tension of said spring;

v) a piston chamber defined by said housing and said piston and a piston chamber passage located in said piston providing fluid communication between said main outlet passage and said piston chamber; and vi) a load chamber defined by said housing and said piston, said load chamber connected to said second load passage, wherein said piston has an effective surface area of 1:1 between an area of said piston acted upon by pressure in said piston chamber and an area of said piston acted upon by pressure in said load chamber, and wherein said piston is in said first position when no pressure is applied to said load chamber.

10. A valve assembly as set forth in claim 9 including a restricting orifice connecting said load sense passage to said first chamber.

* * * * *

UNITED STATES PATENT AND TRADEMARK OFFICE

CERTIFICATE OF CORRECTION

PATENT NO. : 5,487,403

DATED : January 30, 1996

INVENTOR(S) : James R. Mollo

It is certified that error appears in the above-indentified patent and that said Letters Patent is hereby corrected as shown below:

Title page, section '[45] Date of Patent:', "Jan. 30, 1996" should read --*Jan. 30, 1996--.

Title page, after section '[76] Inventor' information, insert the following:

[*] The term of the patent shall not extand beyond the expiration date of Patent No. 5,244,358.

Column 1 Line 40 "the-aforementioned" should read --the aforementioned--.

Column 7 Line 15 "6*a-c*.," should read --6*a-c*,--.

Column 8 Line 23 after "screw" insert --5--.

Claim 4 i) Line 54 Column 12 "sense" should read --sensed--.

Claim 5 Line 29 Column 13 "sense" should read --sensed--.

Claim 5 Line 32 Column 13 "sense" should read --sensed--.

UNITED STATES PATENT AND TRADEMARK OFFICE

CERTIFICATE OF CORRECTION

PATENT NO. : 5,487,403

DATED : January 30, 1996

INVENTOR(S) : James R. Mollo

It is certified that error appears in the above-indentified patent and that said Letters Patent is hereby corrected as shown below:

Claim 8 Line 54 Column 14 "sense" should read --sensed--.

Claim 10 Line 24 Column 16 "sense" should read --sensed--.

Signed and Sealed this

Third Day of September, 1996

*Attest:*

Bruce Lehman

BRUCE LEHMAN

*Attesting Officer*

*Commissioner of Patents and Trademarks*